US005363510A

United States Patent [19]

Chlebek

[11] Patent Number: 5,363,510

[45] Date of Patent: Nov. 15, 1994

[54] PRESSURE RELIEF VENT FOR A WASTE HOLDING TANK

[75] Inventor: Kevin B. Chlebek, Britton, Mich.

[73] Assignee: Thetford Corporation, Ann Arbor, Mich.

[21] Appl. No.: 115,639

[22] Filed: Sep. 3, 1993

[51] Int. Cl.[5] ..... E03D 7/00

[52] U.S. Cl. ..... 4/321; 137/198

[58] Field of Search ..... 4/321, 322, 323; 137/198, 202; 220/DIG. 33

[56] References Cited

U.S. PATENT DOCUMENTS

| | | | |
|---|---|---|---|
| 1,871,984 | 8/1932 | Hoffman | 137/198 |
| 2,625,169 | 1/1953 | Parrish | 137/202 X |
| 2,909,186 | 10/1959 | Larson | 137/202 |
| 4,145,773 | 3/1979 | Sargent et al. | 4/321 |
| 4,520,839 | 6/1985 | Roff | 137/202 |
| 4,776,631 | 10/1988 | Sargent et al. | 4/321 X |
| 4,805,660 | 2/1989 | Antos et al. | 4/321 X |
| 4,982,456 | 1/1991 | Cameron | 4/321 |

*Primary Examiner*—Robert M. Fetsuga

*Attorney, Agent, or Firm*—Harness, Dickey & Pierce

[57] ABSTRACT

A vent for a removable toilet holding tank includes a valve member that is in communication with both the holding tank interior and the ambient atmosphere and is moved off its valve seat when the pressure within the holding tank exceeds the ambient pressure by an amount sufficient to overcome the force of gravity acting to hold the valve member against its valve seat. The vent further includes a second valve member which is operable to close the vent when the holding tank is removed from the toilet bowl thereby precluding spillage of the tank contents during handling of the tank when separated from the toilet bowl.

12 Claims, 3 Drawing Sheets

PRESSURE RELIEF VENT FOR A WASTE HOLDING TANK

BACKGROUND AND SUMMARY OF THE INVENTION

The present invention relates to toilet systems having removable waste holding tanks and in particular to a pressure relief vent for relieving internal pressure build-up within the waste holding tank.

Toilet systems have been developed in which a toilet bowl is removably coupled to a waste holding tank. Waste from the toilet bowl is flushed into the holding tank for storage until disposal at a later time. When the holding tank is filled with waste, it is removed from the bowl and carried to a disposal site where the contents are dumped from the tank.

Such a toilet system can be integrally formed in a recreational vehicle as shown in Assignee's U.S. Pat. No. 4,776,631. Alternatively, the toilet system can be a two-piece portable toilet such as that disclosed in Assignee's U.S. Pat. No. 4,145,773. These patents are hereby incorporated by reference.

The removable waste holding tanks disclosed in the above referenced patents include an inlet port through which waste enters the tank from the toilet bowl. The inlet port is equipped with a valve for closing the port when the toilet is not in use and for opening the port when waste is to be flushed from the toilet into the holding tank. The valve includes an appropriate seal to prevent the escape of odors from the tank and to prevent leakage during handling of the portable tank.

Once waste has accumulated in the holding tank, biological processes take place in the tank to begin the breakdown of the waste. These processes result in the production of vapor within the holding tank, increasing the tank pressure. The pressure within the holding tank may also deviate from the ambient pressure for various other reasons, such as travel to a higher altitude.

A pressure within the tank greater than the ambient pressure can create problems for the user of the toilet. For example, if a liquid, such as a chemical deodorant is introduced into the toilet bowl for flushing into the holding tank, a jet-like gas discharge from the holding tank through the liquid in the bowl may occur as the inlet port valve is initially opened, causing an upward spray of the liquid.

One solution to the problem of pressure build-up within the holding tank is to equip the tank with a vent that is operably coupled to the inlet port valve to open the vent before the tank inlet port is opened. Such a vent arrangement is shown in U.S. Pat. No. 4,776,631 referred to above. While in principal such a vent will relieve pressure from within the holding tank, in practice, insufficient venting often occurs before the inlet port is opened. This is due in part to the speed employed by the operator in opening the tank inlet port. Insufficient venting can result in the same problems encountered with an unvented tank.

Accordingly, it is one object of the present invention to provide an improved vent for a portable waste holding tank.

It is a further object of the present invention to provide a vent for a portable waste holding tank which is only operable to vent the tank when the tank is operatively coupled to the toilet bowl and not while the tank is being transported to a disposal site.

It is yet another object of the present invention to provide a waste holding tank vent that is normally closed to prevent diffusion of odors from the tank into the area surrounding the tank but which will operate to open and relieve small amounts of excess pressure as the pressure is generated.

The vent assembly of the present invention includes a valve body installed in a vent port in the holding tank wall having a vent passage therein for airflow from the tank interior to atmosphere. The valve body includes an upper valve seat surrounding the vent passage at the upper end thereof and an upper valve member is positioned upon the upper valve seat, covering the passage to seal the interior of the holding tank from the surrounding atmosphere. The only force acting to hold the upper valve member on the upper valve seat is gravity. The upper valve member is sufficient to prevent diffusion from the tank.

The bottom surface of the upper valve member is communication with the interior of the holding tank while the top surface of the valve member is in communication with the atmosphere. When the internal pressure in the holding tank exceeds the ambient pressure by a predetermined amount, sufficient to overcome the gravitational force acting on the upper valve member, the internal pressure will lift the upper valve member off the upper valve seat, allowing gas to be vented from the interior of the holding tank. The upper valve member will return by gravity to the upper valve seat, closing the vent passage, when the tank pressure is sufficiently reduced. By constructing the upper valve member to be light weight, only a small amount of gas will be vented each time the upper valve member is removed from its valve seat.

A lower valve seat is formed at the base of the vent passage and a lower valve member is provided for engagement with the lower valve seat to close the vent passage from the tank interior. The lower valve member is held in a closed, sealed position by a biasing spring. A release button is provided for opening the lower valve. The button is depressed by a cam on an upper portion of the toilet system containing the toilet bowl. When the tank is coupled with the toilet bowl, the release button is automatically depressed by the cam, opening the lower valve. The lower valve thus serves to seal the tank when the tank has been removed from the toilet bowl for dumping of its waste contents.

The lower valve member is also provided with a floatation device to raise the lower valve member against the lower valve seat if the tank is overfilled. This prevents spillage of waste through the vent assembly due to overfilling or splashing of the waste contents.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
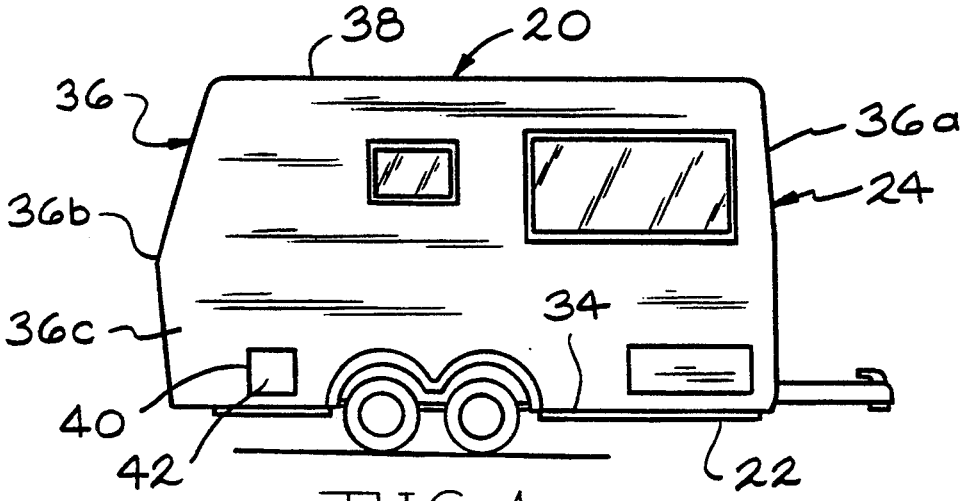
FIG. 1 is a side elevational view of a representative recreational vehicle with a toilet system containing the vent assembly of the present invention.

FIG. 1 illustrates a representative recreational vehicle (RV) 20 containing a toilet system which includes the vent of the present invention. RV 20 comprises a wheeled chassis 22 upon which is supported the RV body 24. Body 24 in general includes a floor 34, a vertical side 36 and a roof 38 forming an enclosure. Side 36 includes four side walls, namely a front wall 36*a*, a rear wall 36*b* and two lateral side walls 36*c*. It is one of these lateral side walls 36*c* which is viewed directly in FIG. 1. Side wall 36*c* is provided with a rectangular opening 40 which is shown in FIG. 1 to be closed by a door 42.

Figure 2:
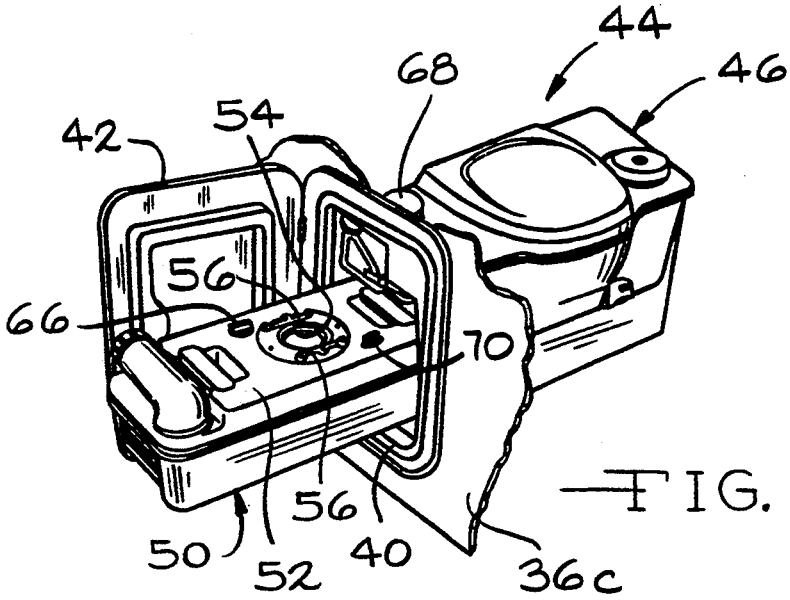
FIG. 2 is a fragmentary perspective view showing the toilet system and its waste holding tank.
Figure 3:
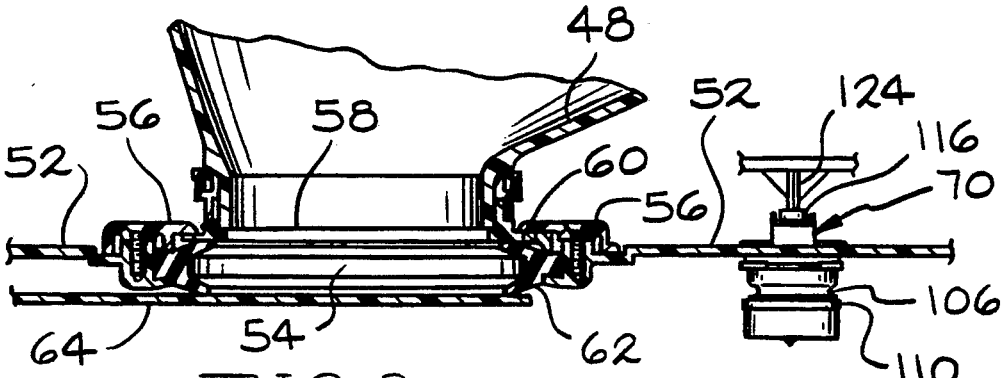
FIG. 3 is a sectional view of the toilet bowl, and holding tank coupling.

Referring now to FIG. 2, the RV contains a water use sanitary toilet 44. The toilet 44 includes an upper portion 46 containing a toilet bowl 48. The toilet 44 further includes a portable waste holding tank 50, which is insertable into the RV body through the opening 40 when the door 42 has been opened. The holding tank 50 includes a top wall 52 having an inlet port 54 therethrough for passage of waste from the toilet bowl 48 into the holding tank. As the tank 50 is moved into the compartment beneath the toilet bowl, guide members 56 on each side of the inlet port 54 and parallel to the direct]on of tank motion, guide the inlet port 54 into registry with the lower outlet 58 of the toilet bowl. The guide members 56 cooperate with annular flange 60 extending radially outwardly about the periphery of the bowl outlet. The inlet port 54 is formed by a seal 62 which seals against the lower edge of the annular flange 60 and against the upper surface of a closure member 64 for closing the inlet port.

The closure member 64 is selectively movable to a position opening the port 54 to enable waste to be flushed from the toilet bowl into the holding tank. When the holding tank is coupled to the toilet bowl, a flush valve actuator 66 on the tank is operatively coupled to a flush knob 68 on the upper portion 46 of toilet 44. Upon actuation of the flush knob 68, the actuator 66 operates to move the closure member 64 horizontally away from the port 54, enabling waste to flow from the bowl into the holding tank. As the closure member 64 is moved to an open position, if the internal pressure within the holding tank is greater than the ambient pressure, the release of this internal pressure can cause the waste or other liquid in the bowl, above the closure member 64, to spray upwardly from the toilet bowl. In order to properly vent the holding tank, the tank is equipped with a vent assembly 70 of the present invention, mounted in an opening in the top wall 52 of the holding tank.

Figure 4:
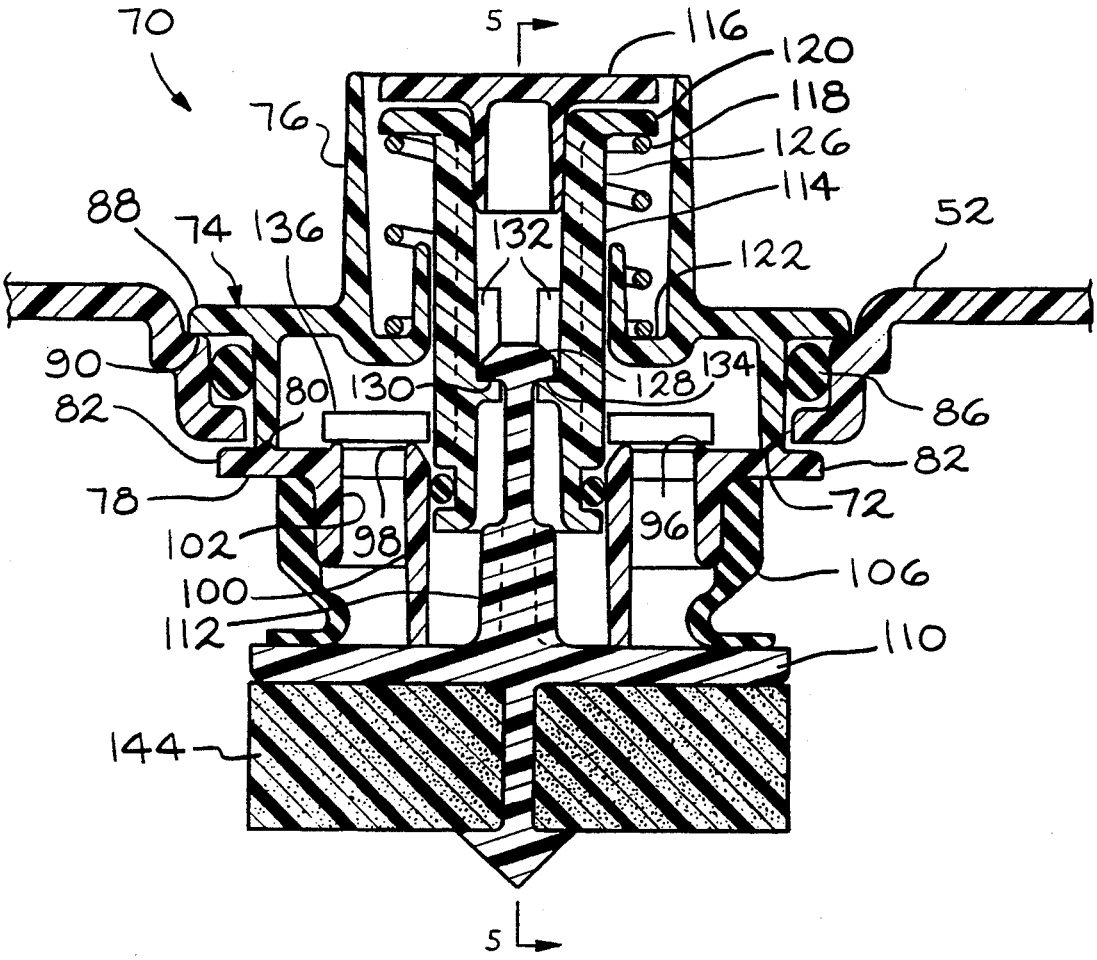
FIG. 4 is a sectional view of the vent assembly of the present invention as seen substantially from the line 4—4 of FIG. 5 showing the vent assembly closed.
Figure 5:
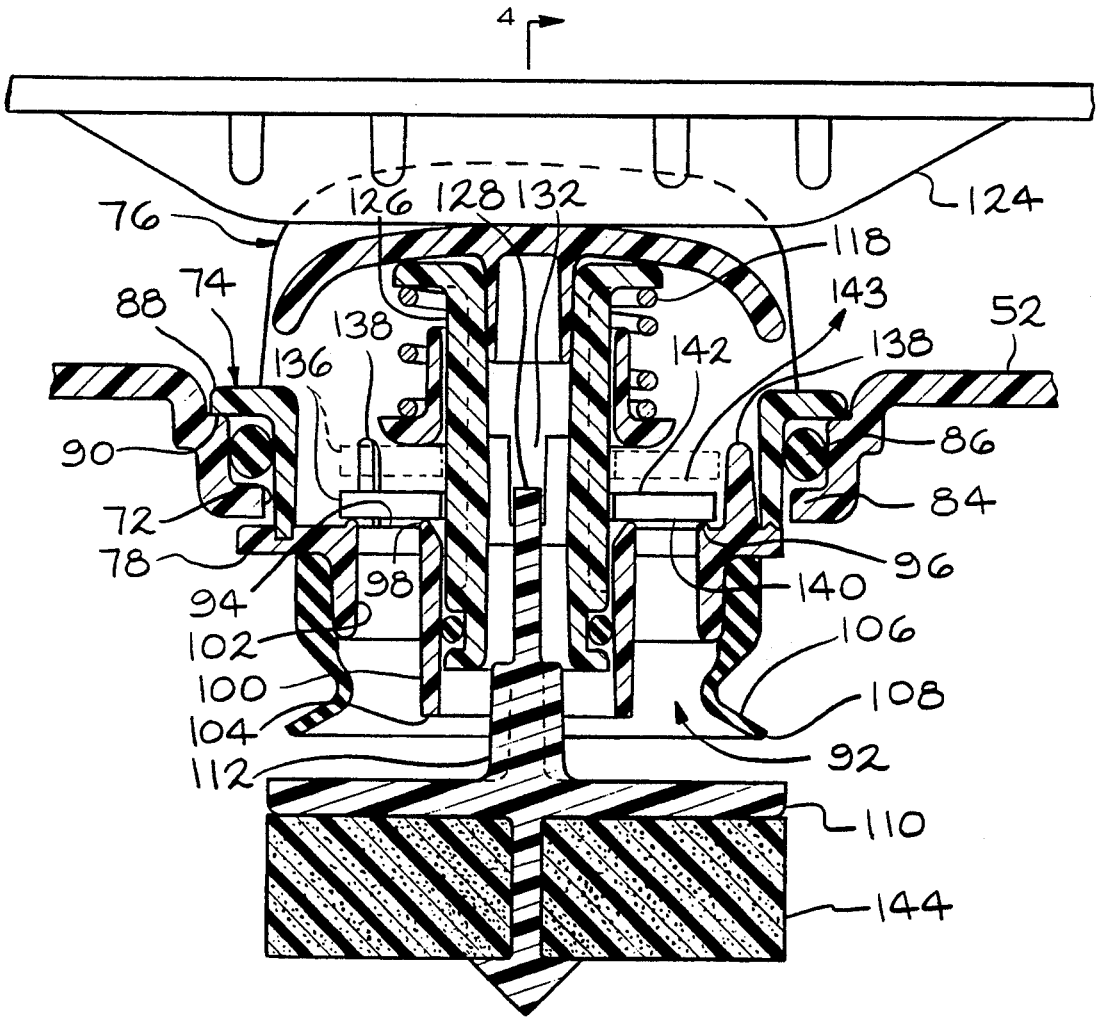
FIG. 5 is a sectional view of the vent assembly of the present invention as seen substantially the lines 5—5 of FIG. 4 showing the vent assembly open.

The vent assembly 70 is shown in greater detail in FIGS. 4 and 5. Vent assembly 70 is installed within a recessed aperture 72 in the tank top wall 52. The vent assembly 70 includes a vent body 74 constructed of an upper portion 76 and a lower portion 78 joined together at 80 by sonic welding, adhesive, etc. The vent assembly is installed and held within the aperture 72 by circumferentially spaced lobes 82 which fit beneath the periphery of aperture 72 through corresponding spaced cut outs 84 in the periphery of the aperture. O-ring 86 provides a seal between the vent body 74 and the tank top wall 52. Annular flange 88 seats upon the ledge 90 of the top wall to vertically support the vent assembly.

The vent body 74 forms a generally annular vent passage 92 extending vertically for the passage of vapor from the tank interior to the exterior atmosphere. The upper end 94 of the vent passage has axially raised ridges 96 and 98 about the inner and outer peripheries of the passage 92. The raised ridges 96 and 98 form an upper valve seat.

The vent passage 92 is annular in shape formed by an inner cylindrical wall 100 and an outer cylindrical wall 102. The lower end of passage 92 is formed by the bottom 104 of the inner wall 100 and an annular seal 106 extending downward below the outer wall 102. The seal 106 forms a lower valve seat 108. A lower valve member 110 is engagable with the lower valve seat as shown in FIG. 4 to close the vent passage 92 from the tank interior. The lower valve member 110 thus operates as closure means for the passage 92 when the holding tank 50 is removed from the opening 40.

The lower valve member 110 includes a valve stem 112 which extends upwardly through the center of the vent body. The valve stem 112 is coupled to a release button 114 which includes a cap 116 at the upper end of the vent assembly. A biasing spring 118, positioned between a flange 120 of the button and a spring seat 122 in the vent body, operates to bias the button into a raised position in which the lower valve member is seated against the lower valve seat 108, sealing the vent passage 92 from the tank interior.

Figure 6:
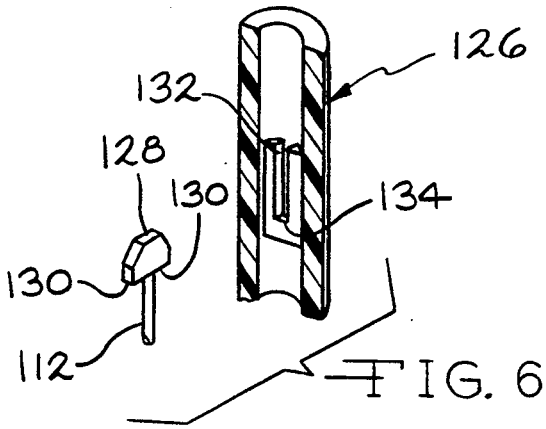
FIG. 6 is an exploded perspective view of the coupling between the lower valve member stem and the vent assembly release button.

When the tank is coupled with the toilet bowl, a cam 124 extending downward from the upper portion of the toilet engages the cap 116, depressing the button 114. The cam 124 thus operates as a release means for the biasing spring 118 by overcoming the force of spring 118 on lower valve member 110 to allow the lower valve member 110 to drop away from the lower valve seat 108, opening the passage 92 to the tank interior. With reference to FIG. 6, the connection between the button core 126 and the valve stem 112 is shown in greater detail. The upper end 128 of stem 112 forms a generally T-shaped section having a pair of lower surfaces 130. The inner hollow cylinder of the button core 126 includes a pair of slots 132 each having a lower wall 134. The lower walls 134 engage the lower surfaces 130 of the valve stem upper end to vertically support the valve stem and lower valve member 110. When the spring 118 has urged the button upward, the valve stem and lower valve member are raised to close the lower end of the vent passage 92. However, when the button is depressed by the cam 124, the lower valve member 110 is allowed to drop by gravity to open the vent passage but the lower valve member is not forced down by operation of the button.

An annular upper valve member 136 is positioned around the button core 126 and rests upon the raised ridges 96 and 98 forming the upper valve seat. Vertical projections 138 circumferentially spaced around the upper valve member operate to hold the upper valve member in position during assembly of the vent prior to insertion of the button core. Once the button and button core have been installed, the upper valve member 136 will be restrained radially by the button core.

The upper valve member 136 is held upon the upper valve seat solely by the affect of gravity acting on the upper valve member. When the holding tank is coupled with the toilet and the lower end of the passage 92 is open, the lower surface 140 of the upper valve member is in communication with the interior of the holding tank. Conversely, the upper surface 142 of the upper valve member is in communication with the ambient atmosphere as shown by the arrow 143.

When the pressure within the holding tank exceeds the ambient pressure and produces an upward force on the upper valve member 136 greater than the gravitational force holding the upper valve member down, the pressure force will cause the valve member to raise toward an upper position shown in phantom lines in FIG. 5. In this position, gas is allowed to vent from the holding tank to relieve the internal pressure. Once the pressure has been reduced, the upper valve member will again drop by gravity onto the upper valve seat. When the upper valve member is seated on its valve seat, it will prevent diffusion of gas from the holding tank into the area surrounding the toilet. The pressure differential between the tank interior and the atmosphere necessary to raise the upper valve member is determined by the weight of the upper valve member and its exposed surface areas. The pressure differential necessary to lift the upper valve member will also affect the quantity of gas relieved from the tank each time the upper valve member is opened. The lower the necessary pressure differential, the less gas will be released.

The vent operates to avoid the build up of pressure within the holding tank while at the same time maintaining the tank substantially closed so that the odors within the tank do not permeate into the surrounding atmosphere. When the tank is disconnected from the toilet bowl and carried to a disposal facility, the vent will be closed automatically by the lower valve member 110 to prevent spillage of the tank contents during transport.

The lower valve member 110 is equipped with a float 144. The float will operate to raise the lower valve member 110 in the event the tank contents reach the level of the float 144. This results in closure of the vent assembly to prevent leakage due to overfilling or splashing of the tank contents.

While the vent assembly of the present invention has been disclosed and described in the context of a recreational vehicle sanitary toilet having a removable holding tank, it is readily apparent that any toilet system with a waste holding tank, such as a two-piece portable toilet having a removable holding tank, can utilize the vent of the present invention.

It is to be understood that the invention is not limited to the exact construction illustrated and described above, but that various changes and modifications may be made without departing from the spirit and scope of the invention as defined in the following claims.

We claim:

1. A water use sanitary system having an upper portion containing a sanitary fixture with a bottom discharge outlet for removing waste from said fixture and a waste holding tank removably coupled to said discharge outlet for receiving waste from said fixture for storage of the waste, a vent assembly venting the interior of the waste holding tank to relieve excessive internal pressure from said holding tank, said vent assembly comprising:

a vent body having an opening therethrough forming a passage for air flow from said tank interior to atmosphere, said passage having a first end exposed to the atmosphere and a second end exposed to the tank interior and said vent body including a first valve seat surrounding said passage at said first end;

a first valve member positioned upon said first valve seat covering said opening to close the interior of the tank from atmosphere, said first valve member being held against said first valve seat by gravity, said first valve member having an interior surface in communication with the interior of the holding tank through said passage and an exterior surface in communication with atmosphere whereby when the internal pressure in said tank exceeds atmospheric pressure by an amount sufficient to overcome the force of gravity on said first valve member, said first valve member is moved off said first valve seat allowing gas from said tank interior to be vented to atmosphere until the internal pressure in the tank is reduced sufficiently for said first valve member to be returned by gravity against said first valve seat to cover said opening; and closure means for closing said passage from said tank interior when said holding tank is removed from said discharge outlet of said sanitary fixture.

2. The water use system of claim 1 wherein said closure means includes:

a second valve seat surrounding the passage at the second end thereof;

a second valve member movable into engagement with said second valve seat to close and seal said passage from the interior of said tank;

bias means for applying a moving force on said second valve member to move said second valve member into engagement with said second valve seat to prevent the discharge of the tank contents through said passage during handling of the tank; and release means for overcoming said moving force on said second valve member when said tank is coupled to said sanitary fixture whereby said second valve member is disengagable from said second valve seat thereby placing said passage in communication with said tank interior and permitting excess pressure within said tank to be vented through said passage.

3. The water use system of claim 2 wherein:

said bias means includes a button coupled to said second valve member and a compression spring disposed between said button and said vent body to move said second valve member against said second valve seat; and said release means includes a cam operable to engage and depress said button in opposition to said spring allowing said second valve member to move away from said second valve seat.

4. The water use system of claim 2 wherein said second valve member is lifted into engagement with said second valve seat and further comprising float means for lifting said second valve member into engagement with said second valve seat to prevent leakage of the tank contents through said passage in the event the level of waste in said tank reaches said second valve member.

5. A water use sanitary system comprising:

an upper portion containing a water use fixture . having a lower discharge outlet through which waste is drained from said fixture;

a holding tank removably coupled to said discharge outlet for receiving waste therefrom, said tank being removable from said fixture to enable the disposal of waste from said tank, said tank having a top wall with a port therethrough for receiving the waste and a second port therethrough;

a vent assembly disposed in said second port for venting the interior of said tank to the ambient atmosphere, said vent assembly including a vent body having an opening therethrough forming a passage for air flow from said tank interior to atmosphere, said passage having an upper end exposed to atmosphere and a lower end exposed to the tank interior and said vent body including an upper valve seat surrounding said passage at said upper end; and an upper valve member positioned upon said upper valve seat covering said opening to close the interior of the tank from atmosphere, said upper valve member being held against said upper valve seat by gravity, said upper valve member having an interior surface in communication with the interior of the holding tank and an exterior surface in communication with atmosphere whereby when the internal pressure in said tank exceeds atmospheric pressure by an amount sufficient to overcome the force of gravity on said upper valve member, said upper valve member is raised off said upper valve seat allowing gas from said tank interior to be vented to atmosphere until the internal pressure in the tank is reduced sufficiently for said upper valve member to be return by gravity onto said upper valve seat to cover said opening.

6. The water use system of claim 5 further comprising:

a lower valve seat surrounding the passage at the lower end thereof;

a lower valve member below said lower valve seat liftable into engagement with said lower valve seat to close and seal said passage from the interior of said tank;

bias means for applying a lifting force on said lower valve member to lift said lower valve member into engagement with said lower valve seat to prevent leakage of waste from said tank through said passage during handling of said tank; and release means associated with the toilet bowl for overcoming the lifting force applied to said lower valve member whereby said lower valve member is free to fall by gravity from said lower valve seat when said tank is coupled to the upper portion of the sanitary system thereby placing said passage in communication with said tank interior and permitting excess pressure within said tank to be vented through said passage.

7. The water use system of claim 6 further comprising:

float means for lifting said lower valve member into engagement with said lower valve seat to prevent leakage of waste from the tank through said passage in the event that the level of waste in said tank reaches said lower valve member.

8. The water use system of claim 6 wherein said release means include a depressible button at the top of said vent assembly and cam means mounted to said sanitary system upper portion for engagement with said button when said tank is coupled to said sanitary fixture.

9. A vent assembly for a water use sanitary system having an upper portion containing a sanitary fixture with a bottom discharge outlet for removing waste from said fixture and a waste holding tank removable coupled to said discharge outlet for receiving waste from said fixture for storage of the waste, said vent assembly venting the interior of the waste holding tank to relieve excessive internal pressure from said holding tank, said vent assembly comprising:

a vent body having a pair of radially spaced cylindrical walls extending vertically to form a vertical annular vent passage between said walls having upper and lower ends for air flow from said tank interior to the ambient atmosphere, said vent body including an upper valve seat surrounding said passage at the upper end thereof;

an annular upper valve member disposed upon said upper valve seat covering said passage to close the interior of the tank from atmosphere, said upper valve member being held against said upper valve seat by gravity, said upper valve member having a bottom surface in communication with the interior of the holding tank through said passage and a top surface in communication with atmosphere whereby when the internal pressure in the tank exceeds atmospheric pressure by an amount sufficient to overcome the force of gravity on said upper valve member, said upper valve member is lifted off said upper valve seat allowing gas from the tank interior to be vented to atmosphere until the internal pressure in the tank is reduced sufficiently for said upper valve member to be returned by gravity onto said upper valve seat to close said passage.

10. The vent assembly of claim 9 further comprising:

a flexible seal at the periphery of said passage and extending downwardly from the radially outermost of said cylindrical walls forming said lower end of said passage;

a lower valve member below said seal movable between a raised position in engagement with said seal to close and seal said passage and a lowered position disengaged from said flexible seal whereby said passage is in communication with said tank interior, said lower valve member including a valve stem extending upwardly from said lower valve member within the radially innermost cylindrical wall of said vent body;

bias means coupled to said valve stem for raising said lower valve member into said raised position; and release means for selectively overcoming said bias means whereby said lower valve member is movable by gravity to said lowered position disengaged from said seal when the tank is coupled to said sanitary fixture thereby placing said passage in communication with the tank interior and permitting excess pressure within the tank to be vented through said passage.

11. The vent assembly of claim 10 wherein:

said bias means includes a button coupled to said valve stem and extending upwardly therefrom to an enlarged cap portion, a compression spring disposed between said button cap portion and a spring seat on said vent body to lift said button and said lower valve member; and said release means includes a cam operable to depress said button in opposition to said spring.

12. The vent assembly of claim 10 further comprising:

a float coupled to said lower valve member for lifting said lower valve member into said raised position in engagement with said lower valve seat to prevent leakage of waste from the tank through said passage in the event that the level of waste in the tank reaches said lower valve member.

* * * * *